US006968264B2

(12) United States Patent
Cripps

(10) Patent No.: US 6,968,264 B2
(45) Date of Patent: Nov. 22, 2005

(54) METHOD AND SYSTEM FOR CONTROLLING A MECHANICAL ARM

(75) Inventor: Donald Lewis Cripps, Smithfield, UT (US)

(73) Assignee: Deere & Company, Moline, IL (US)

( * ) Notice: Subject to any disclaimer, the term of this patent is extended or adjusted under 35 U.S.C. 154(b) by 207 days.

(21) Appl. No.: 10/613,708

(22) Filed: Jul. 3, 2003

(65) Prior Publication Data

US 2005/0004734 A1 Jan. 6, 2005

(51) Int. Cl.[7] ..... G06F 19/00

(52) U.S. Cl. ..... 701/50; 414/699; 172/4.5; 37/414

(58) Field of Search ..... 701/50; 414/697, 414/699; 172/2, 4, 4.5; 37/348, 414, 415, 37/907

(56) References Cited

U.S. PATENT DOCUMENTS

| | | | | |
|---|---|---|---|---|
| 4,829,418 | A * | 5/1989 | Nielsen et al. | 700/59 |
| 4,889,466 | A * | 12/1989 | Jindai et al. | 414/694 |
| 5,178,510 | A * | 1/1993 | Hanamoto et al. | 414/694 |
| 5,257,177 | A * | 10/1993 | Bach et al. | 700/61 |
| 5,446,981 | A * | 9/1995 | Kamada et al. | 37/348 |
| 5,704,141 | A | 1/1998 | Miura et al. | 37/348 |
| 6,233,511 | B1 | 5/2001 | Berger et al. | 701/50 |
| 6,532,738 | B2 | 3/2003 | Sharkness et al. | 60/468 |

FOREIGN PATENT DOCUMENTS

EP 0835964 A2 * 4/1998

* cited by examiner

*Primary Examiner*—Gary Chin

(57) ABSTRACT

A system and method for controlling a mechanical arm comprises planning a desired path of a mechanical arm. An actual path segment of the mechanical arm is measured. An error is determined between the measured actual path segment and the planned desired path. A corrective force is applied to the mechanical arm based on the determined error to conform to the desired path.

22 Claims, 5 Drawing Sheets

METHOD AND SYSTEM FOR CONTROLLING A MECHANICAL ARM

FIELD OF THE INVENTION

The invention relates to a method and system for controlling a mechanical arm.

BACKGROUND OF THE INVENTION

In the prior art, a controller controls the path of a mechanical arm by following time-dependent commands that instruct the mechanical arm to follow a desired path. Although the commands are applied to the mechanical arm in a closed-loop configuration, the mechanical arm follows the desired path in an open loop manner because there is no direct measurement or feedback of the mechanical arm's deviation from the desired path. If the desired path of the mechanical arm is blocked, the commands may not compensate for the presence of the blockage. Accordingly, the mechanical arm, its propulsion system or a work site may be damaged from the mechanical arm's interaction with the blockage. Thus, a need exists for a controller that controls a mechanical arm to correct the movement of a mechanical arm from an actual path to a desired path.

SUMMARY OF THE INVENTION

A system and method for controlling a mechanical arm comprises planning a desired path of a mechanical arm. An actual path segment of the mechanical arm is measured. An error is determined between the measured actual path segment and the planned desired path. A corrective force is applied to the mechanical arm based on the determined error to conform to the desired path.

DESCRIPTION OF THE PREFERRED EMBODIMENT

Figure 1:
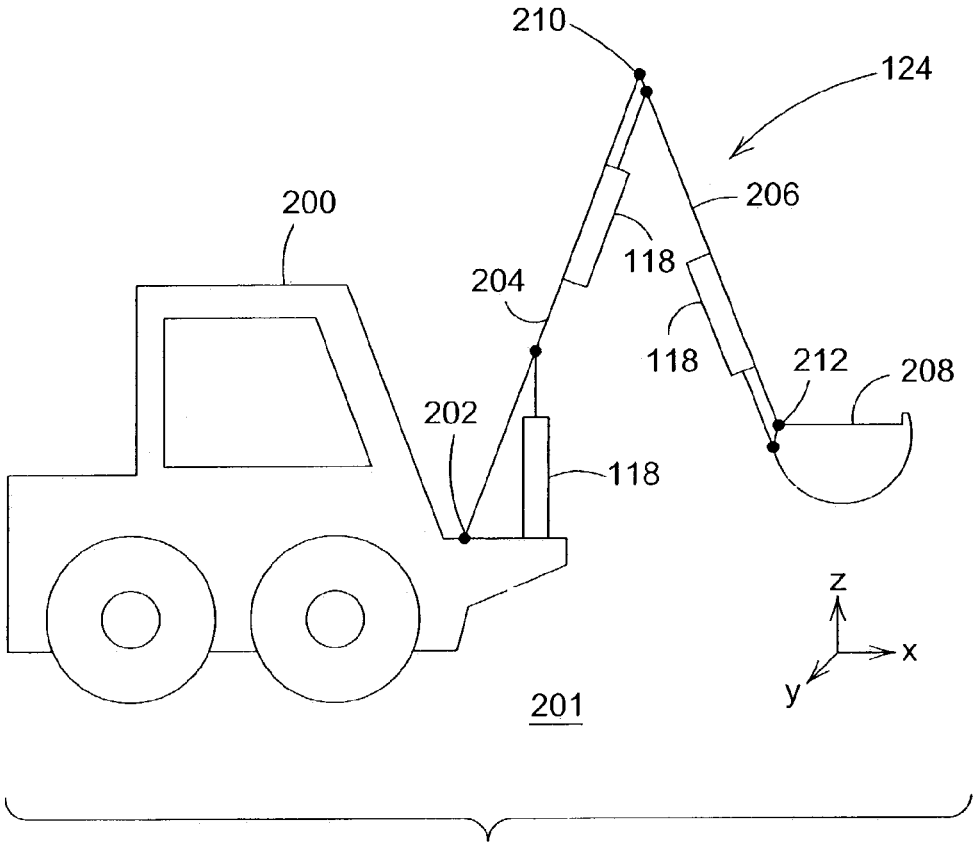
FIG. 1 is a diagram of a machine having a mechanical arm.

FIG. 1 shows an illustrative representation of a machine 201 having a mechanical arm 124. Other configurations of mechanical arms may fall within the scope of the invention and the claims. The machine 201 may comprise a backhoe, a construction machine or some other machine or equipment. The mechanical arm 124 comprises a first segment 204, a second segment 206, and a terminal portion 208. The first segment 204 may be movably connected to a machine housing 200 via a first joint 202. The first segment 204 is movably joined to the second segment 206 via a second joint 210. The second segment 206 is movably connected to the terminal portion 208 via a third joint 212. One or more actuators 118 move(s) the mechanical arm 124 or portions thereof. The terminal portion 208 may comprise a scoop, a bucket, a mechanical pliers, a mechanical hand, a tool or a tool connector, for example.

Each joint (202, 210, and 212) generally permits at least one of its associated segments (204, 206) or the terminal portion 208 to rotate or pivot in at least one plane within a defined range of motion. In a first embodiment, the first joint 202 supports hinged movement in two generally perpendicular planes, which may be designated the first plane and the second plane. The first plane may be the x-z plane, whereas the second plane, perpendicular to the first plane, may be in the x-y plane. As illustrated in FIG. 1 the x-z plane is coextensive with the plane of the sheet of the drawing and the x-y plane is generally perpendicular to that plane, extending into and out of the sheet. Further, in the first embodiment, the second joint 210 supports hinged movement in the x-z plane, and the third joint 212 supports hinged movement in at least the x-z plane.

In a second embodiment, the first joint 202 and the second joint 210 are the same as those described in conjunction with the first embodiment. However, the third joint 212 for the second embodiment comprises a robotic wrist joint that supports a tool or tool connector. The robotic wrist joint may move in two or more planes. The robotic wrist may comprise a roll-pitch-roll wrist, which includes a first roll joint and a second roll joint with an intervening pitch joint between and interconnecting the first roll joint and the second pitch joint. A tool connector or tool is associated with the second roll joint.

Figure 2:
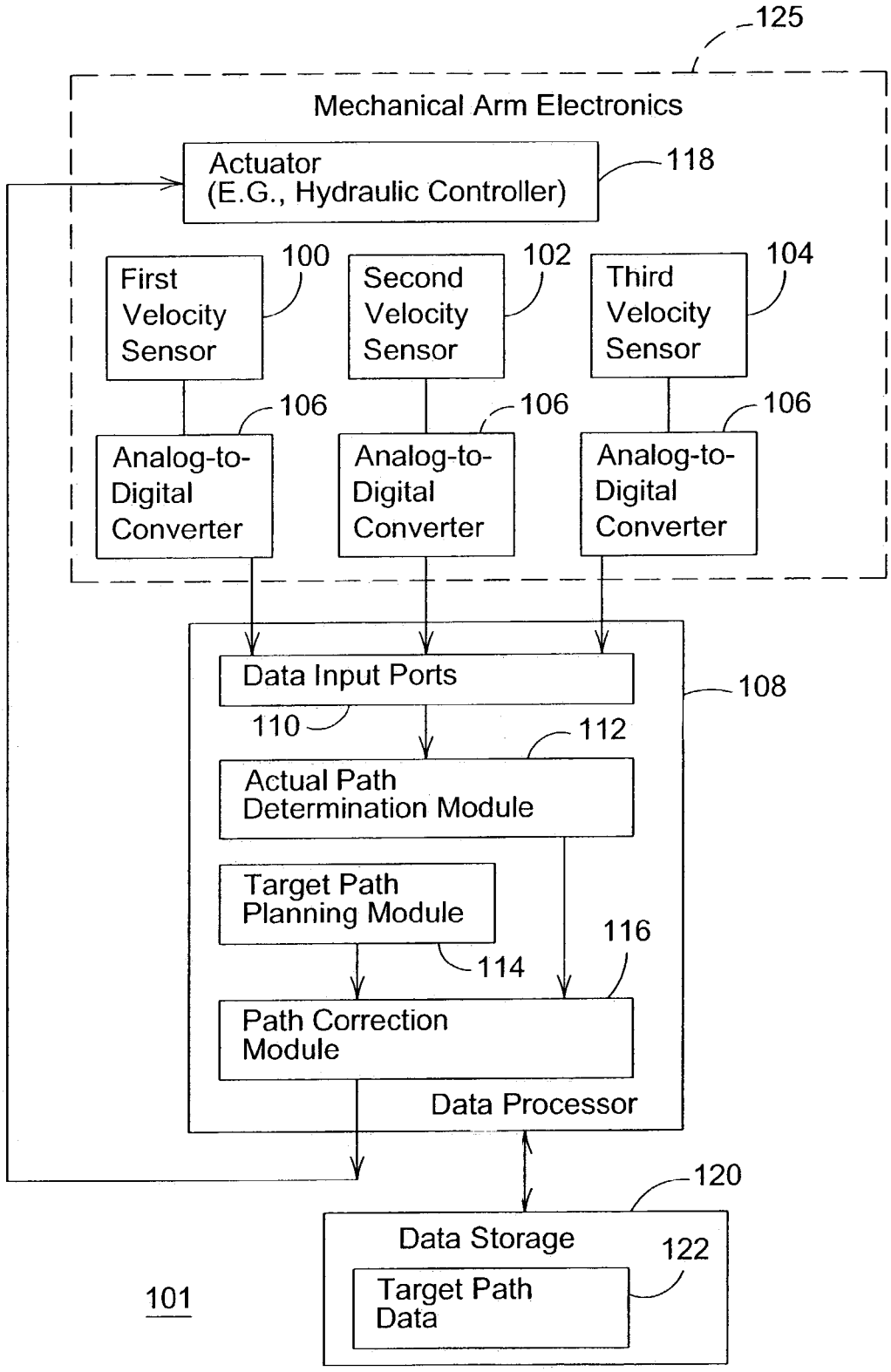
FIG. 2 is a block diagram of a system for controlling a mechanical arm.

FIG. 2 shows a block diagram of a system 101 for controlling a mechanical arm, such as a mechanical arm 124 of FIG. 1. A data processor 108 is coupled to a data storage device 120 and mechanical arm electronics 125. The data processor 108 comprises one or more data input ports 110, an actual path determination module 112, a target path planning module 114, and a path correction module 116. The data storage device 120 may store target path data 122, correction data, and other data.

Velocity sensors (100, 102, and 104) are associated with corresponding joints (202, 210, and 212) of the mechanical arm 124. In one embodiment, a velocity sensor (100, 102, and 104) comprises a position sensor for measuring the displacement of a joint component of a joint and a timer for measuring the time associated with the respective displacement. The velocity sensor (100, 102, and 104) may output raw velocity data for the joint. The raw velocity for each joint may be translated to provide an overall velocity for a reference point (e.g., terminal portion 208 or geometric center of the third joint 212) of the mechanical arm 124. In one configuration, the error reference point comprises the center of the third joint 212 of a mechanical arm 124. The overall velocity data is the rate at which a position of the mechanical arm 124 at a reference point changes over time. The velocity may be expressed as displacement vector per scalar unit time.

In an alternate embodiment, the velocity sensors may be replaced with acceleration sensors which determine the rate of change of velocity over time. The derivative of velocity equals acceleration. Conversely, because the integral of acceleration may be used to determine the velocity, an accelerometer and an integrator may be used in combination to provide the equivalent of a velocity sensor.

The first velocity sensor 100 may be associated with the first joint 202 for measuring the position displacement versus time of the first joint 202. The second velocity sensor 102 may be associated with the second joint 210 for measuring the position displacement versus time of the second joint 210. The third velocity sensor 104 may be associated with the third joint 212 for measuring the position displacement versus time of the third joint 212. The first velocity sensor 100, the second velocity sensor 102, and the third velocity sensor 104 preferably provide relative displacement and respective time measurements for components of the joints. The components of the joints move with respect to each other and may represent hinges that rotate about one or more axes. If the first velocity sensor 100, the second velocity sensor 102, and the third velocity sensors 104 have analog outputs as shown, the outputs of the velocity sensors are coupled to respective analog-to-digital converters 106.

However, in an alternate embodiment, the outputs of the velocity sensors (100, 102, and 104) may be in a digital format that renders the analog-to-digital converters 106 of FIG. 2 unnecessary.

The outputs of the analog-to-digital converters 106 feed data input ports 110 of the data processor 108. In turn, the data input ports 112 provide actual path data to the actual path determination module 112. The actual path data may represent actual velocity data or actual motion data with respect to one or more joints of the mechanical arm 124. The actual path determination module 112 provides a three-dimensional path versus time for the mechanical arm 124 with respect to a reference point. The actual path determination module 112 may reflect an actual path that is produced by a human operator manning the controls of the machine 201 incorporating the mechanical arm 124, for example.

A target path planning module 114 may facilitate the definition of a target path or desired path based on one or more of the following factors: the geometry of the mechanical arm 124, the planned work task for the mechanical arm 124, the identity of the machine to which the mechanical arm 124 is operably connected, and an optimal or preferential path of a skilled experienced operator of the machine or mechanical arm 124. The desired path or target path may be expressed as target path data 122 that provides an optimal motion or preferential trajectory for the mechanical arm 124. Further, the target path may support preferential movement of the mechanical arm 124, if the mechanical arm 124 is exposed to a blockage in an actual path or the target path. The storage device 120 may store target path data 122 on a desired path or target path of a mechanical arm 124.

The path correction module 116 generates a corrective signal for application to one or more actuators 118 of the mechanical arm 124. The path correction module 116 provides a control signal to at least one actuator 118 to achieve the determined hydraulic flow rate. The path correction module 116 may comprise an error determination module that determines an error between the measured actual path segment and the planned desired path. The error determination module determines a deviation between desired velocity vectors associated with the planned target path and actual velocity vectors associated with the actual path segment. The path correction module 116 applies a corrective force to the mechanical arm 124 based on the determined error to conform to the desired path. An actuator 118 may comprise one or more of the following: a hydraulic controller, an electromechanical controller for controlling a hydraulic line or input, a hydraulic valve, an electrical motor, a servo-motor for applying force to one or more components of the mechanical arm 124, a hydraulic member, and a hydraulic cylinder. For example, the actuator 118 may comprise the combination of a hydraulic controller and one or more hydraulic cylinders to change the actual path of a reference point of the mechanical arm 124 to the desired path of the reference point of the mechanical arm 124.

The actuators 118 may be embodied in various alternative configurations. In a first embodiment of the actuators 118, a hydraulic controller first actuator controls a corresponding first hydraulic member associated with the mechanical arm 124; a second hydraulic controller controls a corresponding second hydraulic member associated with the mechanical arm 124. The combination of the first hydraulic controller (e.g., an electrically controlled hydraulic valve) and the first hydraulic member (e.g., a hydraulic cylinder) comprises a first actuator. The combination of the second hydraulic controller (e.g., an electrically controlled hydraulic valve) and the second hydraulic member (e.g., a hydraulic cylinder) comprises a second actuator. A path correction module (e.g., 116) divides hydraulic flow between the first actuator and the second actuator. The first actuator is associated with a progress vector consistent with the actual path segment and the second actuator is associated with an orthogonal corrective vector. The orthogonal corrective vector is generally orthogonal to the progress vector. The corrective vector and the progress vector are synonymous with the corrective velocity component and the progress velocity component, and are defined in greater detail in conjunction with FIG. 4.

In a second embodiment of the actuators 118, the actuators comprise hydraulic members, such as hydraulic cylinders. Each hydraulic member is arranged for moving one or more segments with respect to a corresponding joint of the mechanical arm 124. The path correction module 116 is arranged to apply a hydraulic flow rate applicable to the hydraulic member for the desired corrective force. The path correction module 116 provides a control signal to at least one actuator 118 to achieve the determined hydraulic flow rate.

In a third embodiment of the actuators 118, a servo-valve controller controls a hydraulic member (e.g., a hydraulic cylinder) for moving one or more segments with respect to a corresponding joint of the mechanical arm 124. The servo-valve controller provides error feedback for correction of the hydraulic flow rate of the hydraulic member.

Figure 3:
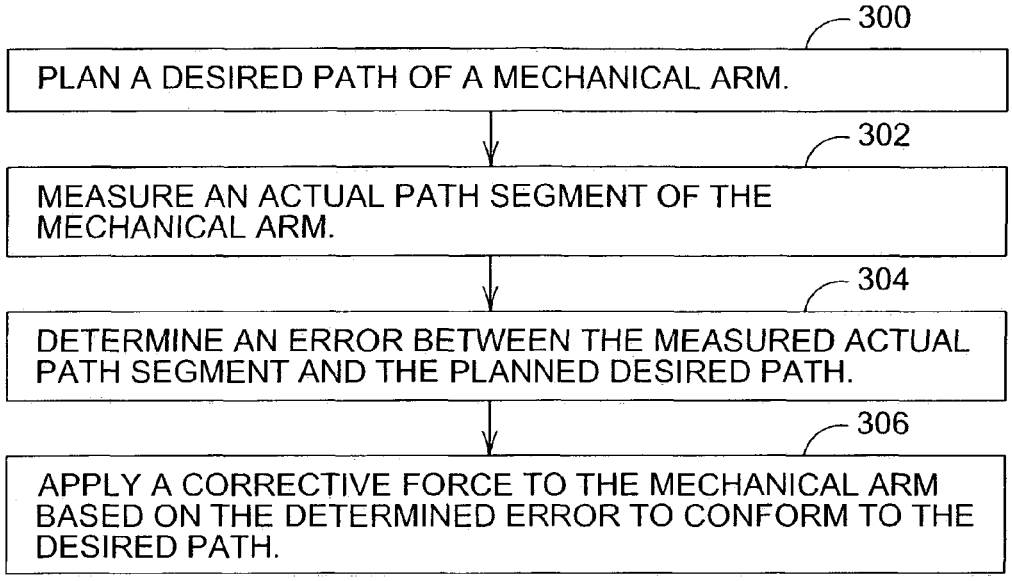
FIG. 3 is a flow chart of a method for controlling a mechanical arm.

FIG. 3 illustrates a method for controlling a mechanical arm 124. The method of FIG. 3 starts in step 300.

In step 300, a target path planning module 114 or a data processor 108 plans a desired path of a mechanical arm 124. The target path plan or desired path may represent a preferential trajectory for the mechanical arm 124 which avoids joint limits, singularities, excessive loads, obstructions or inefficient movements. Joint limits may be associated with limitations of the range of motion of a mechanical joint (202, 210, and 212). Singularities may be associated with one or more orientations of the joint in which excessive joint velocities are generated. An inefficient movement may result from obstructions, operator fatigue, sloppy operator commands or improper timing of a sequence of operator instructions. The target path plan may compensate for such inefficient movement for a particular corresponding work task by providing a model for the movement of a reference point on the mechanical arm 124. The target path plan may differ with a selected corresponding work task and may require an operator's (e.g., experienced professional's) definition of the target path plan in a controlled environment.

In one embodiment, the planned path represents a desired path 400 that is stored in a data storage device 120 for reference. An applicable target path plan may be selected from a library of planned paths based on the closest operator input to the planned target path or based on the mechanical arm 124 or the terminal portion 208 encountering an obstruction. In one configuration, the planned path is selected based on the closest approximation between operator input to a target path. Alternately, an applicable or preferential target path plan may be associated with a corresponding particular work task, for example.

In step 302, velocity sensors (100, 102, and 104) feed data to an actual path determination module 112 to measure an actual path segment of the actual path of the mechanical arm 124. The actual path segment is determined by position versus time measurements at one or more joints (202, 210, and 212) of the mechanical arm 124. Step 302 may include converting raw analog velocity data from one or more velocity sensors to digital data and applying the raw digital velocity data to an actual path determination module 112 via data input ports 110. Each raw digital velocity datum may be specific to a corresponding joint (202, 210 or 212) of the mechanical arm 124. Accordingly, the actual path determination module 112 converts the raw digital velocity data to velocity data referenced to a reference point (e.g., a terminal portion 208 or a central point within the third joint 212) on the mechanical arm 124.

In step 304, a path correction module 116 or data processor 108 determines an error between the measured actual path segment and the planned desired path or target path plan of step 300. Further, the path correction module 116 may control (e.g., send a control signal to) one or more actuators 118 based on the determined error.

In one example, the determination of the error in step 304 represents determining a deviation between desired velocity vectors associated with the planned path and actual velocity vectors associated with the actual path segment. Here, both the desired velocity vectors and the actual velocity vectors are referenced to the same reference point of the mechanical arm 124 or one of its joints (202, 210, and 212).

In another example, the determination of an error in step 304 further comprises converting the determined error into hydraulic flow rates applicable to at least one joint of the mechanical arm 124 for the desired corrective force; and providing a control signal to at least one actuator 118 to achieve the determined hydraulic flow rates for at least one hydraulic member (e.g., hydraulic cylinder) associated with a corresponding joint of the mechanical arm 124.

In step 306, one or more actuators 118 may apply a corrective force to the mechanical arm 124 based on the determined error to conform to the desired path or target path plan. For example, the actuator 118 may comprise a hydraulic controller that causes the mechanical arm 124 to move with respect to a corrective velocity component (e.g., corrective velocity component 401 of FIG. 4). In one example, the corrective force comprises an orthogonal corrective vector that is generally orthogonal to a progress vector of the mechanical arm 124. In another example, the corrective force comprises the resultant vector formed by the combination or vector addition of an orthogonal corrective vector and a progress vector. The orthogonal vector is generally orthogonal to a progress direction of the mechanical arm 124 and the progress vector is consistent with the actual path segment of the mechanical arm 124.

Step 306 may be carried out in accordance with various techniques or procedures, which may be executed alternately or cumulatively. In accordance with a first technique, corrective force comprises a generally orthogonal corrective vector orthogonal to a progress vector of the mechanical arm 124 consistent with the actual path segment. In accordance with a second technique, the corrective force comprises the combination of an orthogonal corrective vector and progress vector, the orthogonal vector being generally orthogonal to a progress direction of the mechanical arm 124 and the progress vector consistent with the actual path segment of the mechanical arm 124. In accordance with a third technique, the corrective force divides hydraulic flow between a first actuator and a second actuator, the first actuator associated with an orthogonal corrective vector and a second actuator associated with a progress vector consistent with the actual path segment. Each of the actuators 118 may control or include a hydraulic member associated with the mechanical arm 124. In accordance with a fourth technique, an error feedback is provided for correction of the hydraulic flow rate of the at least one joint. In accordance with a fifth technique, an error feedback is provided for correction of the control signal to at least one actuator 118.

Figure 4:
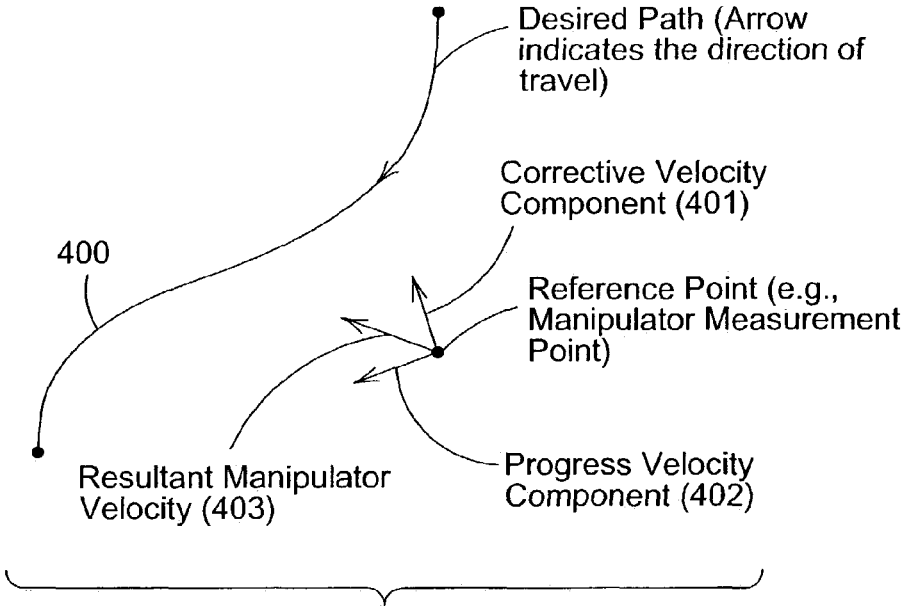
FIG. 4 is a diagram of an illustrative desired path of a mechanical arm.

FIG. 4 illustrates a desired path 400 or target path plan of a reference point on the mechanical arm 124. The direction of travel of the desired path 400 is indicated by the arrows. Any point along the desired path 400 may be defined by a vector called a progress velocity component 402. If a measurement point versus time or velocity datum is on the desired path 400, there is no corrective velocity component 401. However, if the measured velocity datum is not on the desired path 400, there is generally a corrective velocity component 401. The corrective velocity component 401 is generally orthogonal to the progress velocity component 402. The resultant velocity component 403 is the vector sum of the progress velocity component 402 and the corrective velocity component 401.

Positional error of the mechanical arm 124 may be directly measured from the current position of the reference point (e.g., center of the third joint 212 of the mechanical arm 124) to a point lying on the desired path 400. The shortest distance between the actual path and the desired path 400 is chosen as the error between the measured position and desired position. In one embodiment, the resultant positional error is processed through a compensation device to create correction velocity component 401 in a direction so as to reduce or gradually eliminate the error in a non-abrupt manner. The progress velocity component 402 or progress vector drives the arm 124 along the desired path 400. The progress velocity component 402 is substantially orthogonal to the error vector and is formed from the velocity vector at the normal point on the desired path 400. In one configuration, the combination of the corrective velocity component 401 and the progress velocity component 402 constitutes the command motion to the mechanical arm 124. Path information includes a tangential velocity at each point and a manipulator angle or angle of the joint.

Figure 5:
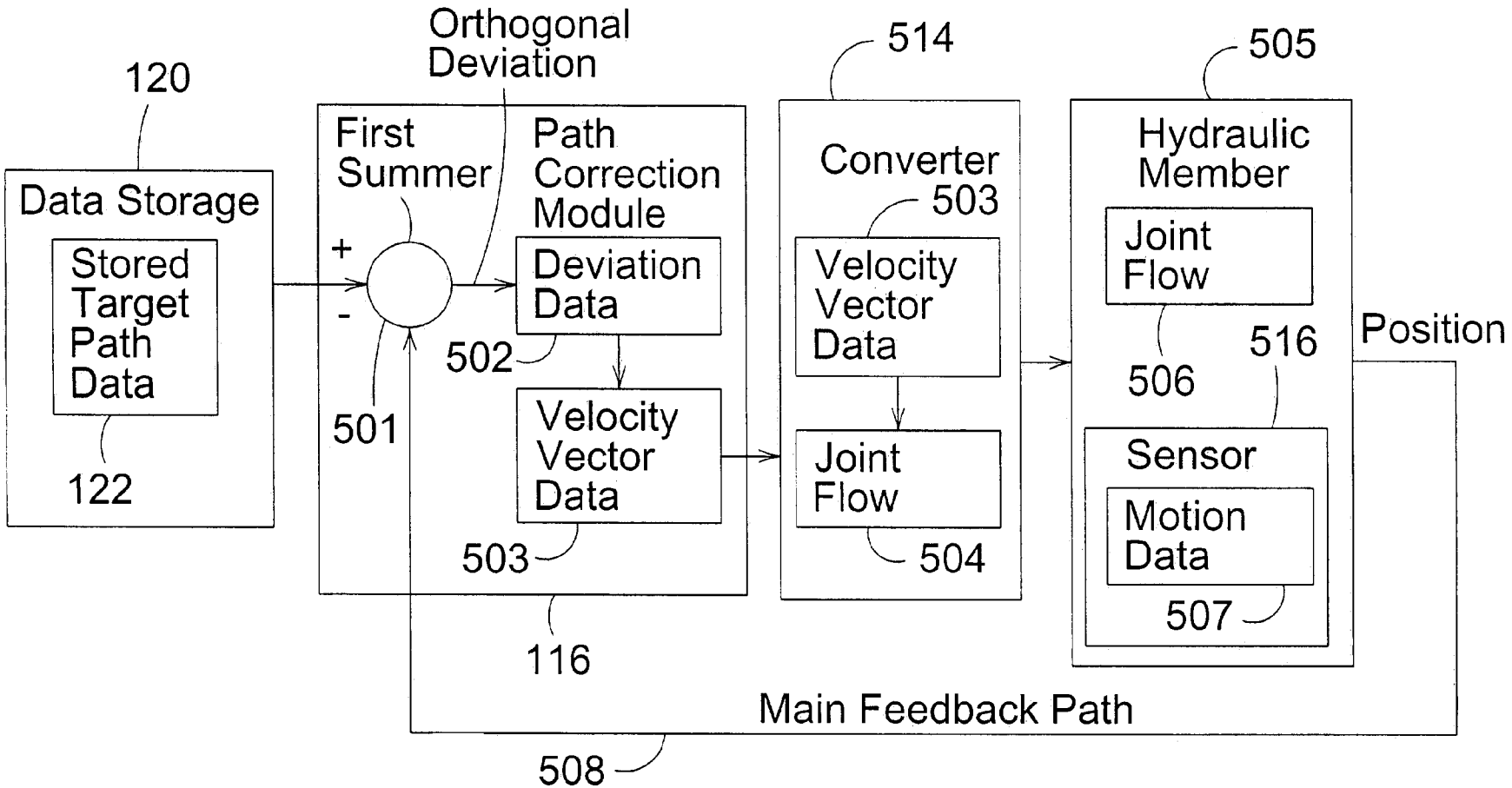
FIG. 5 is a block diagram of one embodiment of a system for controlling a mechanical arm.

FIG. 5 is a block diagram of a control system for controlling a position of a reference point on the mechanical arm 124 with positional feedback of the reference point. The control system of FIG. 5 may be applied to the machine 201 of FIG. 1. The system 101 of FIG. 2 may be used to execute the control system of FIG. 5 with or without software and/or hardware modification. Like reference numbers in FIG. 1, FIG. 2, and FIG. 5 indicate like elements.

The target path or desired path is determined with reference to a reference point (e.g., a central point of the third joint 212) of the mechanical arm 124. The target path data 122 is stored in a data storage device 120 or elsewhere.

The path correction module 116 determines the orthogonal deviation between the actual position of the reference point of the mechanical arm 124 and the target path data 122 for the mechanical arm 124. The path correction module 116 comprises a first summer 501 that receives target path data 122 (as input) and motion data 507 (as feedback) and outputs orthogonal deviation data 502. The orthogonal deviation data 502 may be used to generate corrective velocity vector data 503. The deviation data 502 and the corrective velocity vector data 503 may be defined in terms of three spatial dimensions in Cartesian coordinates, spherical coordinates, radial coordinates or the like.

The path correction module 116 feeds the velocity vector data 503 to the converter 514. The converter 514 provides a particular corresponding joint flow 504 in response to the input of the velocity vector data 503. The converter 514 converts the corrective velocity vector data 503 into corresponding requisite joint flow 504 to hydraulic members 505 associated with one or more joints (202, 210 and 212). In one embodiment, the converter 514 may be incorporated in a hydraulic controller or actuator for generating a desired joint flow.

A hydraulic member 505 (e.g., hydraulic pistons) may convert the joint flow 504 into motion or a position of the mechanical arm 124. A sensor 516 (e.g., a velocity sensor or accelerometer) records or registers the position as motion data 507 for feedback to the first summer 501. One or more sensor(s) 516 is/are positioned on the mechanical arm to provide motion data 507. The motion data 507 or related data is sent to the first summer 501 via the main feedback path 508. The hydraulic members 505 convert the hydraulic flow from the converter 514 to a motion, which one or more sensors 516 measure in terms of actual position versus time of a reference point of the mechanical arm 124. The motion data 507 or velocity data provides positional feedback to improve the conformance of the actual path of the desired path of the mechanical arm 124.

Figure 6:
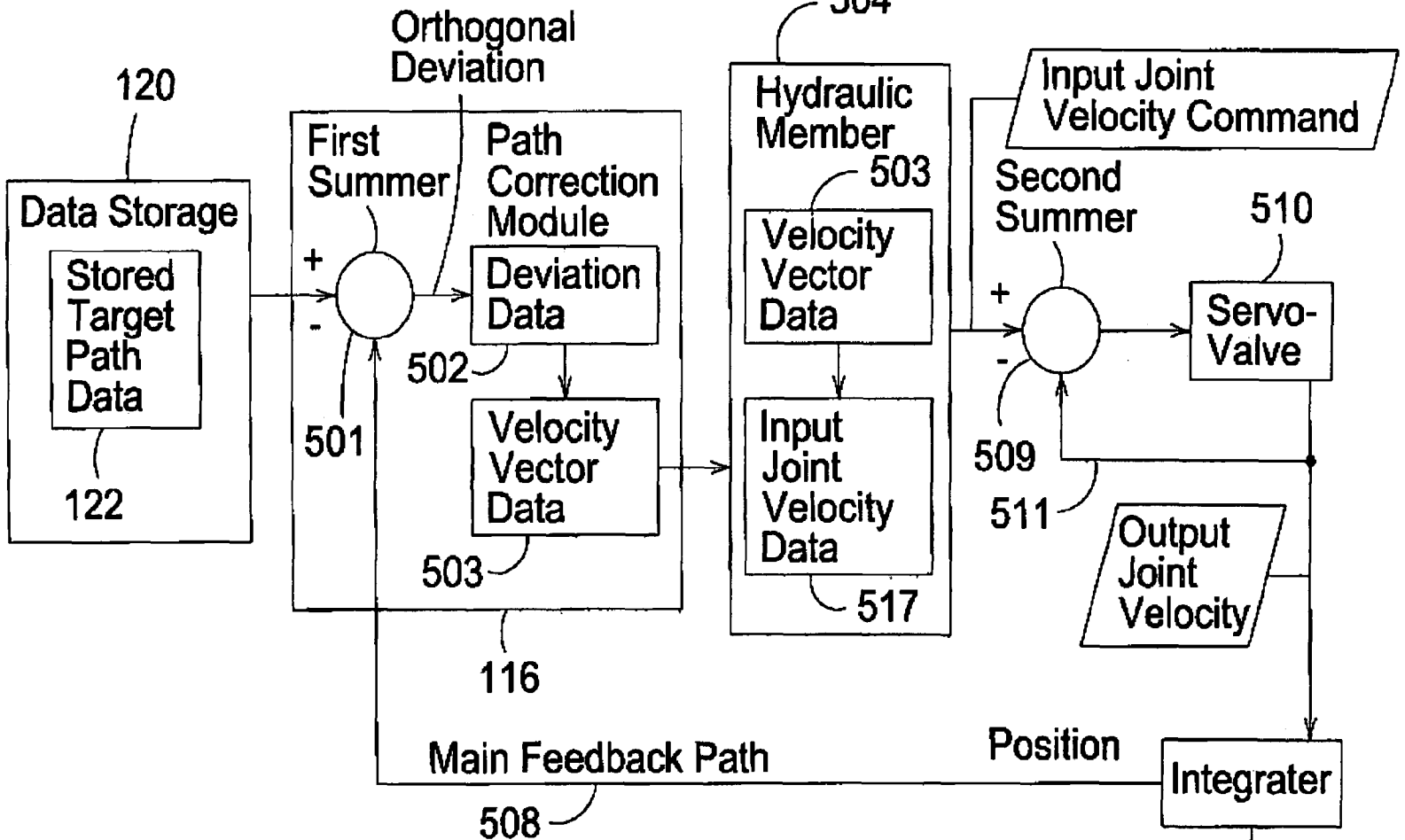
FIG. 6 is a block diagram of another embodiment of a system for controlling a mechanical arm with minor loop control of a joint flow velocity.

FIG. 6 is a block diagram of a control system which is similar to the control system of FIG. 5, except the control system of FIG. 6 features a minor loop control of joint flow velocity and other modifications supporting the minor loop control. Like reference numbers in FIG. 5 and FIG. 6 indicate like elements.

A hydraulic controller 504 may convert the corrective velocity vectors or velocity vector data 503 into corresponding requisite input joint velocity data 517. Each hydraulic member has a hydraulic valve, a servo-valve adjustment, an electro-mechanical valve or another mechanism for controlling the flow of hydraulic fluid to the hydraulic member. The application of the input joint velocity data 517 to the servo-valve 510 yields actual joint velocity data or output joint velocity data. The actual joint velocity data may be fed back to a second summer 509 or minor feedback path 511 to obtain an error signal for adjusting the input joint velocity data 517 to attain a desired actual joint velocity data. As shown, the error signal may be applied to a servo-valve 510 for adjusting hydraulic flow to a corresponding hydraulic member.

An integrator 512 may integrate the output joint velocity data or actual joint velocity data to yield motion data 516, which may be expressed as a position versus time for a reference point on the mechanical arm 124. The motion data 516 is fed back to the first summer 511 via a main feedback path 508 to provide any orthogonal deviation data 502 between the actual motion data and the desired motion data of the target path plan.

One advantage of the method and system of the invention is that it removes the strict time dependence of control of the mechanical arm by spatially determining the deviation of the mechanical arm from a desired path. Accordingly, the method and system facilitates operation of the mechanical arm in a more contained, refined and/or predictable fashion than otherwise possible. For example, the method and system of the invention may be configured to apply a steady force to any blockage or concave obstacle in the path (e.g., the desired path) while continuing to move along the surface of the convex obstacle in the path.

Having described the preferred embodiment, it will become apparent that various modifications can be made without departing from the scope of the invention as defined in the accompanying claims.

I claim:

1. A method for controlling a mechanical arm, the method comprising:

planning a desired path of the mechanical arm selected from a library of target path plans to avoid at least one of a joint limit, a singularity, an obstruction or an inefficient movement;

measuring an actual path segment of the actual path of the mechanical arm through one or more velocity sensors associated with corresponding joints of the mechanical arm;

determining an error between the measured actual path segment and the planned desired path; and applying a corrective force to the mechanical arm based on the determined error to conform to the desired path; the corrective force comprising an orthogonal corrective vector orthogonal to a progress vector of the mechanical arm consistent with the actual path segment.

2. The method according to claim 1 wherein the desired path is defined with reference to a reference point on the mechanical arm; the reference point associated with a central point of a joint of the mechanical arm.

3. The method according to claim 1 wherein the corrective force comprises the orthogonal corrective vector and the progress vector, the orthogonal vector orthogonal to a progress direction of the mechanical arm and the progress vector consistent with the actual path segment of the mechanical arm.

4. The method according to claim 1 wherein the applying divides hydraulic flow between a first actuator and a second actuator, the first actuator associated with the orthogonal corrective vector and a second actuator associated with the progress vector consistent with the actual path segment, each actuator including at least one hydraulic controller for controlling a hydraulic member associated with the mechanical arm.

5. The method according to claim 1 wherein the desired path is stored in a data storage device for reference, and wherein the desired path is selected based on the mechanical arm encountering an obstruction in the actual path.

6. The method according to claim 1 wherein the actual path segment is determined by translating position versus time measurements at one or more joints of the mechanical arm to a reference point associated with the mechanical arm.

7. The method according to claim 1 wherein the determining of the error represents determining a deviation between desired velocity vectors associated with the desired path and actual velocity vectors associated with the actual path segment.

8. The method according to claim 1 wherein the applying comprises:

converting the determined error into hydraulic flow rates applicable to at least one joint of the mechanical arm for the desired corrective force; and providing a control signal to at least one actuator to achieve the hydraulic flow rates for at least one hydraulic member associated with a corresponding joint of the mechanical arm.

9. The method according to claim 8 further comprising:

providing an error feedback for correction of the hydraulic flow rate of the at least one joint, the error feedback being consistent with the applied corrective force.

10. The method according to claim 8 further comprising:

providing an error feedback for correction of the control signal to the at least one actuator, the error feedback being consistent with the applied corrective force.

11. A system for controlling a mechanical arm, the system comprising:

a storage device for storing a desired path of the mechanical arm among a library of target path plans to avoid at least one of a joint limit, a singularity, an obstruction or an inefficient movement;

a position sensor for measuring an actual path segment of an actual path of the mechanical arm, the position sensor comprising a velocity sensor associated with a corresponding joint of the mechanical arm;

an error determination module for determining an error between the measured actual path segment and the desired path; and a path correction module for applying a corrective force to the mechanical arm based on the determined error to conform to the desired path; the corrective force comprising an orthogonal corrective vector being generally orthogonal to a progress vector of the mechanical arm consistent with the actual path segment.

12. The system according to claim 11 wherein the desired path is defined with reference to a reference point on the mechanical arm; the reference point associated with a central point of a joint of the mechanical arm.

13. The system according to claim 11 wherein the corrective force comprises the orthogonal corrective vector and the progress vector, the orthogonal vector being generally orthogonal to a progress direction of the mechanical arm and the progress vector consistent with actual path segment of the mechanical arm.

14. The system according to claim 11 further comprising:

a first actuator comprising a first hydraulic controller and a first hydraulic member, the first hydraulic controller arranged for controlling the first hydraulic member associated with the mechanical arm;

a second actuator comprising a second hydraulic controller and a second hydraulic member, the second hydraulic controller arranged for controlling the second hydraulic member associated with the mechanical arm; and the path correction module dividing hydraulic flow between the first actuator and the second actuator, the first actuator associated with the orthogonal corrective vector and the second actuator associated with the progress vector consistent with the actual path segment.

15. The system according to claim 11 wherein the desired path is selected based on the closest approximation between operator input to the desired path within the library of available desired paths.

16. The system according to claim 11 wherein the desired path is stored in the data storage device for reference, and wherein the desired path is selected based on the mechanical arm encountering an obstruction in the actual path.

17. The system according to claim 11 wherein the actual path segment is determined by position versus time measurements at one or more joints of the mechanical arm.

18. The system according to claim 11 wherein the error determination module determines a deviation between desired velocity vectors associated with the desired path and actual velocity vectors associated with the actual path segment.

19. The system according to claim 11 further comprising:

a hydraulic member for moving a corresponding joint of the mechanical arm;

the path correction module arranged to apply a hydraulic flow rate applicable to the hydraulic member for the desired corrective force, the path correction module providing a control signal to at least one actuator to achieve the applied hydraulic flow rate.

20. The system according to claim 11 further comprising a servo-valve controller for controlling a hydraulic member for moving a corresponding joint of the mechanical arm, the servo-valve controller providing error feedback for correction of a hydraulic flow rate of the hydraulic member.

21. The system according to claim 11 wherein the path correction module provides an error feedback for correction of a control signal to at least one actuator.

22. The system according to claim 11 further comprising a target planning module for planning the desired path.

* * * * *